US006436533B1

(12) United States Patent
Heffner et al.

(10) Patent No.: US 6,436,533 B1
(45) Date of Patent: Aug. 20, 2002

(54) MELT SPUN FIBERS FROM BLENDS OF POLY(TETRAFLUOROETHYLENE) AND POLY(TETRAFLUOROETHYLENE-CO-PERFLUORO-ALKYLVINYL ETHER)

(75) Inventors: Glenn William Heffner, Centerville; William Cheng Uy, Hockessin; Martin Gerald Wagner, Wilmington, all of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/892,336

(22) Filed: Jun. 28, 2001

Related U.S. Application Data

(60) Provisional application No. 60/220,994, filed on Jul. 27, 2000.

(51) Int. Cl.[7] ..... D01F 6/00; D01F 8/00

(52) U.S. Cl. ..... 428/364; 428/373; 428/394; 428/421; 525/200

(58) Field of Search ..... 428/364, 373, 428/374, 394, 421, 422; 525/200

(56) References Cited

U.S. PATENT DOCUMENTS 4,252,859 A 2/1981 Concannon et al.
4,859,836 A 8/1989 Lunk et al.
4,952,630 A * 8/1990 Morgan et al. ..... 525/72
5,317,061 A * 5/1994 Chu et al. ..... 525/200
5,473,018 A * 12/1995 Namura et al. ..... 525/200
5,807,633 A * 9/1998 Tamura et al. ..... 428/373

FOREIGN PATENT DOCUMENTS

WO WO 91/17551 11/1991
WO WO 00/08071 2/2000

OTHER PUBLICATIONS

"Crystalline Homopolymer–Copolymer Blends: Poly-(terafluoroethylene–co–perfluoroalkylvinyl ether" J. Runt, L. Jin, S. Talibuddin and C.R. Davis *Macromolecules* 28, 2781–2786 (1995).

Phase Behavior of Crystalline Blends of Poly(tetrafluoroethylene) and of Random Fluorinated Copolymers of Tetrafluoroethylene; R. Pucciarello and C. Angioletti, *J. Polymer Science: Part B Polymers Physics*, 27, 679–689 (1999).

* cited by examiner

*Primary Examiner*—N. Edwards

(57) ABSTRACT

The present invention relates to melt spun fibers prepared from blends of poly(tetrafluoroethylene) and poly (tetrafluoroethylene-co-perfluoro-alkylvinyl ether).

19 Claims, 10 Drawing Sheets

PFA/PTFE
◆ 340/1600
□ 340/1000
△ 340/1200
x 340/1300
✱ 350/1600
● 350/1200
+ 340/1600/1000

PFA/PTFE

- ◆ 340/1600
- □ 340/1000
- △ 340/1200
- x 340/1300
- ✱ 350/1600
- ● 350/1200
- + 340/1600/1000

◆ PFA 340

□ PFA 350

PFA/PTFE

△ 340/1600 x 340/1000

✳ 340/1200

● 340/1300

+ 350/1200

◆ Namura Ex. 7

□ Namura Ex. 8

△ PFA340/MP1600

MELT SPUN FIBERS FROM BLENDS OF POLY(TETRAFLUOROETHYLENE) AND POLY(TETRAFLUOROETHYLENE-CO-PERFLUORO-ALKYLVINYL ETHER)

This application claims benefit of Provisional Appln. 60/220,994, filed Jul. 27, 2000.

TECHNICAL BACKGROUND OF THE INVENTION

The present invention concerns blends of poly (tetrafluoroethylene) (PTFE) and poly(tetrafluoroethylene-co-perfluoro-alkylvinyl ether) (PFA) melt spun into fibers.

There is extensive literature on blends of PFA and PTFE. However, the vast majority of the patent and literature work involves dispersion blends where no effort has been made to produce homogeneous melts. Further, the bulk of the work involves commercial, high molecular weight PTFE materials. Typical PTFE polymers that are used to form useful articles are of extremely high molecular weight, of the order of $10^7$. The high molecular weight of these homopolymers creates difficulties in forming fibers via melt processes due to their high melt viscosities. On the other hand PTFE grades with viscosities low enough to be melt processed (less than $10^5$ Pa-s) do not exhibit useful strength as formed articles.

The conditions under which PTFE and PFA may cocrystallize is not clear in the open literature. U.S. Pat. No. 5,473,018 (Namura et al.) discloses certain blends of PTFE with PFA. The tensile strength of molded bars is measured therein. Restrictions were placed on the crystallization temperature and heat of crystallization of the PTFE (essentially requiring the PTFE to be below some threshold molecular weight). The claims of this patent concern only blend compositions containing <4% by weight PTFE. This reference also discloses blends of up to 50% PTFE content. Properties of blends of higher PTFE content were not useful in the context of this patent. Namura et al. reported that the tensile strength of molded bars of a 50% PTFE blend reported was approximately 50% of a molded bar of PFA alone. Fibers made from such blends are not mentioned.

The articles "Crystalline Homopolymer-Copolymer Blends: Poly(tetrafluoroethylene)-Poly(tetrafluoroethylene-co-perfluoro-alkylvinyl ether", J. Runt, L. Jin, S. Talibuddin and C. R. Davis, *Macromolecules*, 28, 2781–2786 (1995) and "Phase Behavior of Crystalline Blends of Poly (tetrafluoroethylene) and of Random Fluorinated Copolymers of Tetrafluoroethylene", R. Pucciarello and C. Angioletti, *J. Polymer Science: Part B: Polymer Physics*, 37, 679–689 (1999) describe blends of PTFE and PFA. Runt et al. discovered that PTFE and PFA mixed in aqueous dispersions of the two components crystallize separately under most crystallization conditions investigated and concluded that PFA and PTFE may cocrystallize only under rapid crystallization conditions. In the more recent Pucciarello et al. article PTFE and PFA, under their conditions which utilized dry powder mixing, do not cocrystallize. Pucciarello et al. concluded that the more intimate mixing of the particles of Runt et al. would allow, only in extreme conditions (quenching) cocrystallization of PTFE and PFA.

WO 00/08071 (Smith et al.) concerns blends of PTFE and mentions blends of PTFE with certain copolymers of PTFE. All examples in Smith et al. involve blends of two or more different PTFEs.

BRIEF SUMMARY OF THE INVENTION

The present invention concerns a fiber, comprising a composition comprising a blend of at least one poly (tetrafluoroethylene) and at least one poly (tetrafluoroethylene-co-perfluoro-alkylvinylether).

The present invention also concerns a process of forming a fiber, comprising the steps of: (a) contacting at least one poly(tetrafluoroethylene) with at least one poly (tetrafluoroethylene-co-perfluoro-alkylvinyl ether) to form a blend; (b) heating the poly(tetrafluoroethylene) above the melting point of the poly(tetrafluoroethylene) prior to, simultaneously with, or subsequent to contact with the poly(tetrafluoroethylene-co-perfluoro-alkylvinyl ether); (c) heating the poly(tetrafluoroethylene-co-perfluoro-alkylvinyl ether) above the melting point of the poly (tetrafluoroethylene-co-perfluoro-alkylvinyl ether) prior to, simultaneously with or subsequent to contact with the poly (tetrafluoroethylene); and (d) extruding the molten blend through a die to form a fiber comprising a composition comprising a blend of at least one poly(tetrafluoroethylene) and at least one poly(tetrafluoroethylene-co-perfluoro-alkylvinyl ether).

The present invention further concerns a process of preparing a cocrystallized blend comprising the steps of (a) contacting at least one poly(tetrafluoroethylene) with at least one poly(tetrafluoroethylene-co-perfluoro-alkylvinyl ether) wherein the viscosity of the poly(tetrafluoroethylene) is within two orders of magnitude of the viscosity of the poly(tetrafluoroethylene-co-perfluoro-alkylvinyl ether); (b) mixing the poly(tetrafluoroethylene) and poly (tetrafluoroethylene-co-perfluoro-alkylvinyl ether thoroughly to form a blend; (c) heating the poly (tetrafluoroethylene) above the melting point of the poly (tetrafluoroethylene) prior to, simultaneously with, or subsequent to contact with the poly(tetrafluoroethylene-co-perfluoro-alkylvinyl ether); and (d) heating the poly (tetrafluoroethylene-co-perfluoro-alkylvinyl ether) above the melting point of the poly(tetrafluoroethylene-co-perfluoro-alkylvinyl ether) prior to, simultaneously with or subsequent to contact with the poly(tetrafluoroethylene).

DETAILED DESCRIPTION OF THE INVENTION

Figure 1:
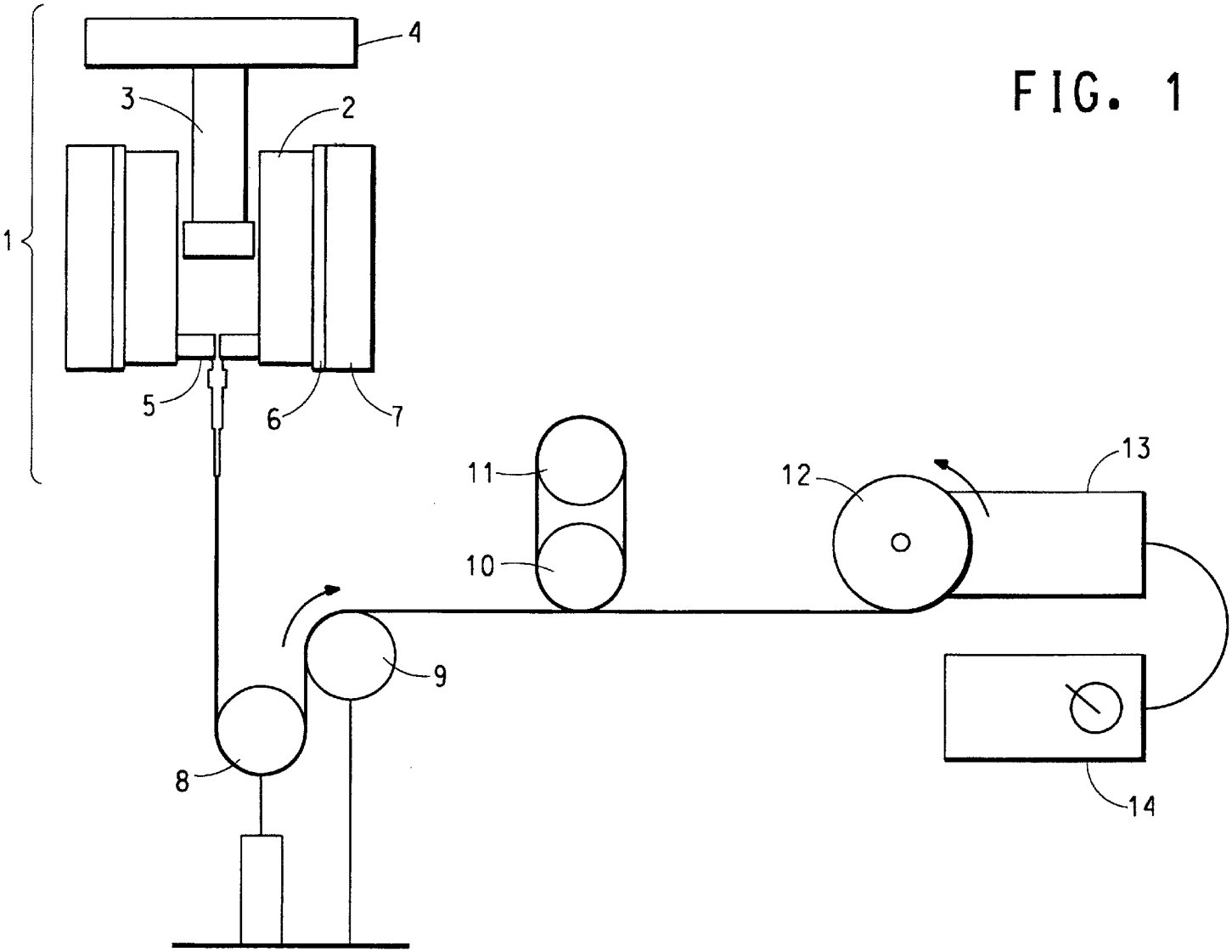
FIG. 1 is a schematic representation of a melt spinning apparatus useful in forming the present fibers.

Compositions used to form the present fibers include blends of poly(tetrafluoroethylene) (PTFE) and poly (tetrafluoroethylene-co-perfluoro-alkylvinyl ether) (PFA). As used herein PFA includes crystalline copolymers of tetrafluoroethylene and at least one perfluoroalkylvinyl ether, with perfluoroalkylvinyl ether content in the copolymer being about 1–10 mol % based on total copolymer with about 1–5 mol % preferred. The copolymer is melt formable by melt extrusion, injection molding, or the like, and has a melt flow rate (MFR) of 0.5–500 g/10 min, preferably 0.5–50 g/10 min at 372° C.+/−1° C. The perfluoroalkylvinyl ether may include perfluoro(methylvinylether) (PMVE), perfluoro(ethylvinylether) (PEVE), perfluoro (propylvinylether) (PPVE), perfluoro(isobutylvinylether), and the like.

Preferably the PFA contains perfluoropropylvinyl ether as comonomer at about 1–2% (mole) concentration. Other perfluoroalkylvinyl ether comonomers can be used. Representative examples of PFA are Teflon® grades 340 and 350 available from E. I. du Pont de Nemours and Company, Wilmington, Del. (DuPont). Teflon® 340 and 350 are TFE/PPVE copolymers with PPVE content in the 1–2% range. The PFA can be in the form of pellets or powder.

The poly(tetrafluoroethylene) (PTFE) used in the present invention is a homopolymer of tetrafluoroethylene (TFE) or is a modified PTFE homopolymer containing not more than 1 wt% of a modifying comonomer, such as hexafluoropropylene (HFP), chlorotrifluoroethylene (CTFE), perfluorobutylethylene (PFBE), a fluoroalkoxytrifluoroethylene, fluoroalkyl ethylene, or a perfluoroalkylvinyl ether (PAVE) compound, such as PMVE, PEVE or PPVE, or the like. PTFE homopolymers used herein can be relatively low in molecular weight. Low molecular weight, in this context, refers to materials that when melted exhibit viscosities that are sufficiently close to the viscosities of the PFA copolymers used herein to permit melt mixing.

Representative examples of useful PTFE homopolymers include Zonyl® MP1000, MP1200, MP1300 and MP1600, available from DuPont.

The amount of PTFE homopolymer in the blend can range from about 5% to about 90% by weight based on the total weight of the blend. Preferably the amount of PTFE homopolymer in the present blends is an amount greater than 50%. More preferably the amount of PTFE homopolymer ranges from about 50% to 90%. Most preferably the amount of PTFE homopolymer ranges from about 50% to 80%.

The PTFE and PFA used to prepare the blend of the present fibers should be close enough in viscosity to permit adequate mixing. This means that the viscosity of the PTFE and PFA are within about two orders of magnitude of each other, preferably one order of magnitude.

The present invention includes a process for forming the fiber of the present invention comprising a composition comprising a blend of at least one poly(tetrafluoroethylene) and at least one poly(tetrafluoroethylene-co-perfluoroalkylvinyl ether), comprising the steps of: (a) contacting at least one poly(tetrafluoroethylene) with at least one poly(tetrafluoroethylene-co-perfluoro-alkylvinyl ether) to form a blend; (b) heating the poly(tetrafluoroethylene) above the melting point of the poly(tetrafluoroethylene) prior to, simultaneously with, or subsequent to contact with the poly(tetrafluoroethylene-co-perfluoro-alkylvinyl ether); (c) heating the poly(tetrafluoroethylene-co-perfluoro-alkylvinyl ether) above the melting point of the poly (tetrafluoroethylene-co-perfluoro-alkylvinyl ether) prior to, simultaneously with or subsequent to contact with the poly (tetrafluoroethylene); and (d) extruding the molten blend through a die to form a fiber comprising a composition comprising a blend of at least one poly(tetrafluoroethylene) and at least one poly(tetrafluoroethylene-co-perfluoro-alkylvinyl ether).

Many options are available for creating the blends useful in the preparation of the fibers of the present invention. For example, the PTFE and PFA can be contacted by dry blending in the desired proportions. Intense mixing can be used and may be attained by utilizing a cage-like propeller mixer on a shaft driven by air motor at high speed. If desired the powder blends can be pelletized prior to being fed into an extruder. Following dry blending and optionally pelletizing, the composition can be fed to an extruder which can heat and mix the blend. Any ordinary mixing device, such as an extruder or internal mixer, that both mixes and heats the materials to above the melting point of the higher melting component can be used in the present process. This mixing device can then be coupled with a melt spinning apparatus. For example, the equipment described in U.S. Pat. No. 6,048,481, incorporated by reference herein, can be used to melt the blend composition described herein and spin the present fibers. In this embodiment, the blend of PTFE and PFA can be heated to a temperature that is above the melting temperature of the component having the higher melting temperature but below its degradation temperature and then optionally cooled and reheated above the higher melting temperature at least once. Residence time must be monitored to ensure that exposure to the temperature above the melting temperature does not result in degradation.

Alternatively, the PTFE and PFA can be fed to separate extruders and separately heated and conveyed and the outputs metered to a mixing device such as a third extruder. Other options are available and known by those of skill in the art. Optional cooling and reheating at least once, as described above, may also be utilized in this embodiment.

Figure 13:
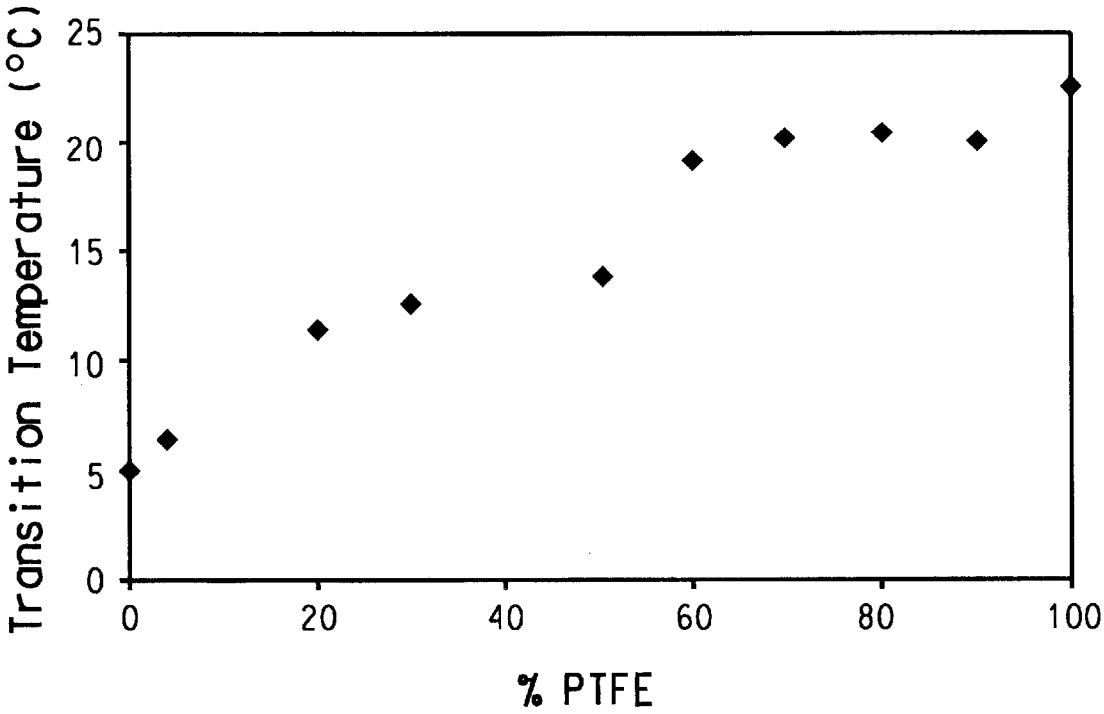
FIG. 13 is a graph of the low temperature transition for Teflon® PFA 340/Zonyl® MP1600 PTFE blends as a function of PTFE content.

As a result of heating the PTFE and PFA above their melting temperatures and mixing adequately, a blend is formed. If the PTFE and PFA are not fully blended, the resulting composition will possess separate crystallization phases and may exhibit two or more melting points. Preferably, a homogeneous blend is formed wherein co-crystallization has occurred. A cocrystallized blend will exhibit essentially a single melting peak in DSC analysis located at an intermediate temperature between the melting points of the unblended components. By "essentially a single melting peak" is meant there is a single peak or the bulk of the peak is a main peak with one or more small peaks or shoulders in addition to the main peak. The essentially single melting peak is opposed to what one may obtain with a simple mixture where separate peaks from both components appear. In addition, a cocrystallized blend will exhibit similar behavior for the crystalline transition that is normally located at about 19° C. for PTFE and at a lower temperature for PFA. The peak temperature of this transition will also exhibit a single peak in DSC analysis and be located at an intermediate temperature between the peaks exhibited by PTFE and PFA (see FIG. 13).

The present invention provides a process for the preparation of the cocrystallized blend comprising the steps of (a) contacting at least one PTFE with at least one PFA wherein the viscosity of the PTFE is within two orders of magnitude of the viscosity of the PFA; (b) mixing the PTFE and PFA thoroughly to form a blend; (c) heating the PTFE above the melting point of the PTFE prior to, simultaneously with, or subsequent to contact with the PFA; and (d) heating the PFA above the melting point of the PFA prior to, simultaneously with or subsequent to contact with the PTFE. In order to attain a cocrystallized blend, the contact between the PTFE and PFA should ensure complete mixing. In some embodiments, it may be necessary to cool a blend, and then reheat it at least once with additional mixing to attain cocrystallization.

The blended output from the extruder can be directly fed to a spinning device, or cut, cooled, collected, for example pelletized, and used as feed for a spinning device. The output from the extruder can alternatively be pelletized and the resultant pellets can then be fed into an extruder where they can be further melted and further mixed, if necessary.

In order to form the fibers of the present invention, the blend described above is melt spun and optionally drawn. Preferably, the spinning speed is greater than 200 mpm, more preferably greater than 500 mpm.

Preferably, the tenacity of the fibers of the present invention are greater than 0.2 gpd. Break elongation of the fibers of the present invention is preferably greater than 20%.

EXAMPLES

Two different PFA and four different PTFE materials were used in the blends of Examples 1–3. All are commercial products sold by DuPont.

| | | DSC Results | | | | | |
|---|---|---|---|---|---|---|---|
| | | First Heat | | Cooling | | Second Heat | |
| Material | MFI* (g/10 min) | Tm (° C.) | ΔHm (J/g) | Tc (° C.) | ΔHc (J/g) | Tm (° C.) | ΔHm (J/g) |
| Copolymers (TFE/perfluoropropylvinylether, Teflon ® PFA): | | | | | | | |
| PFA 340 | 14.9 | 304.28 | 26.95 | 279.82 | 35.75 | 307.37 | 40.33 |
| PFA 350 | 1.68 | 305.63 | 29.16 | 280.44 | 30.38 | 308.64 | 35.07 |
| Homopolymers (Zonyl ® PTFE): | | | | | | | |
| MP1000 | 3.59 | 329.57 | 82.22 | 310.66 | 70.54 | 330.13 | 78.66 |
| MP1200 | ** | 325.58 | 77.19 | 312.35 | 73.07 | 326.54 | 82.16 |
| MP1300 | *** | 332.79 | 67.40 | 314.73 | 71.03 | 330.58 | 70.33 |
| MP1600 | 17.90 | 328.97 | 78.13 | 312.20 | 77.86 | 330.43 | 83.82 |

*MFI-Melt Flow Index - ASTM D2116, 5 kg. Weight, 372° C.
**too high to measure
***not measured (Melt viscosity data would lead one to expect a value much lower than the MFI of MP1000.)

Blends were prepared at various concentrations of the following pairs of materials: PFA 340/MP1000; PFA 340/MP1200; PFA 340/MP1300; PFA 340/MP1600; PFA 350/MP1200; and PFA350/MP1600. In addition, a small number of three component blends of PFA340/MP1000/MP1600 were prepared.

A fiber spinning apparatus employed in the specific embodiments, herein below described, is shown in FIG. 1. A capillary rheometer 1, comprising a heated barrel 2, piston 3, drive mechanism 4, and a die 5, was employed for extruding the melted polymer. The heated cylindrical steel barrel was ca. 10 cm long and ca. 7.5 cm in diameter. A cylindrical corrosion-resistant barrel insert ca. 0.6 cm thick made of Stellite (Cabot Corp., Kokomo, Ind.) provided an inner bore diameter of 0.976 cm. The barrel was surrounded by a 6.4 cm layer of ceramic insulation 7.

An 800-W cylindrical heater band 10 cm long and ca. 7.5 cm in diameter 6, manufactured by (I. H. Co. NY, N.Y.), controlled by an ECS model 6414 temperature controller manufactured by (ECS Engineering, Inc., Evansville, Ind.), maintained the barrel temperature within 1° C. of set point. The piston, made of hardened steel (Armco 17-4 RH) was 0.970 cm dia. at its tip, and was mounted on the crosshead 4, of a model TT-C Instron test frame manufactured by Instru-met, Inc., Union, N.J. Capillary dies of circular cross-section were constructed of Hastelloy (Cabot Corp., Kokomo, Ind.).

In operation, the fiber was extruded vertically downward to a 3.0 cm diameter nylon guide wheel 8 located 30 cm below the die, by which point the fiber had solidified. Guide wheel 8 was mounted on a force transducer (Scaime model GM2, sold by Burco, Centerville, Ohio) used to measure the spin tension. The fiber was wrapped 180° around guide wheel 8 and directed to a second guide wheel 9 (4.8 cm dia.) and from there to a pair of take-up rolls 10 and 11. The fiber was wound once around the take-up rolls, and taken up by a wind-up roll 12. Rolls 10, 11 and 12 were 5 cm in diameter; they were made of aluminum and covered with masking tape for better grip. Roll 11 was free-spinning (on ball-bearings) while rolls 10 and 12 were driven in tandem by a motor 13 having a maximum speed of 3600 rpm. The maximum take-up speed was thus ca. 600 m/min. The motor speed was controlled with a variable transformer 14. In practice the fiber was strung through the apparatus at low speed (ca. 10 m/min), then the speed was increased gradually to the desired take-up rate.

In Examples 1–3, the PTFE used was in the form of a powder. PFA was either in the form of pellets or powder. Materials were weighed out in the correct ratio and physically blended by agitating in a plastic bag. This blended material was then used as feed to a 16-mm twin screw co-rotating extruder. The extruder had five separate heating zones. The zone at the feed point was operated with a set point of 350° C., while the other zones were all set at 365° C. These conditions produced an extrudate that exhibited a temperature of about 375° C. The extruder was operated at a screw speed of 100 rpm and the feed to the extruder was adjusted to maintain the pressure in the extruder barrel and the torque on the screws at a level within the manufacturers' suggested limits for the machine. The extrudate was water cooled and chopped into pellets. These pellets were then used as feed for a second pass through the extruder. The material was given three to five passes through the extruder in order to obtain uniformity in the blending process.

Differential Scanning Calorimetry (DSC) was used to assess the completeness of the mixing process. For selected compositions, samples of blend pellets were collected after each pass and subjected to DSC analysis. These tests indicated that complete mixing was achieved after two passes through the extruder. This was judged by the lack of any changes in the DSC data after subsequent passes when compared with the data collected after the second pass. The samples were heated from 0° to 400° C., cooled to 0° and then reheated to 400° C. The results of the second heat, except for the PFA 340/MP 1300 pair showed only a dominant single melting peak, usually with a very small peak or shoulder at a somewhat lower temperature. The PFA 340/MP 1300 blends continued to exhibit two distinct melting peaks at all PTFE levels tested.

Figure 2:
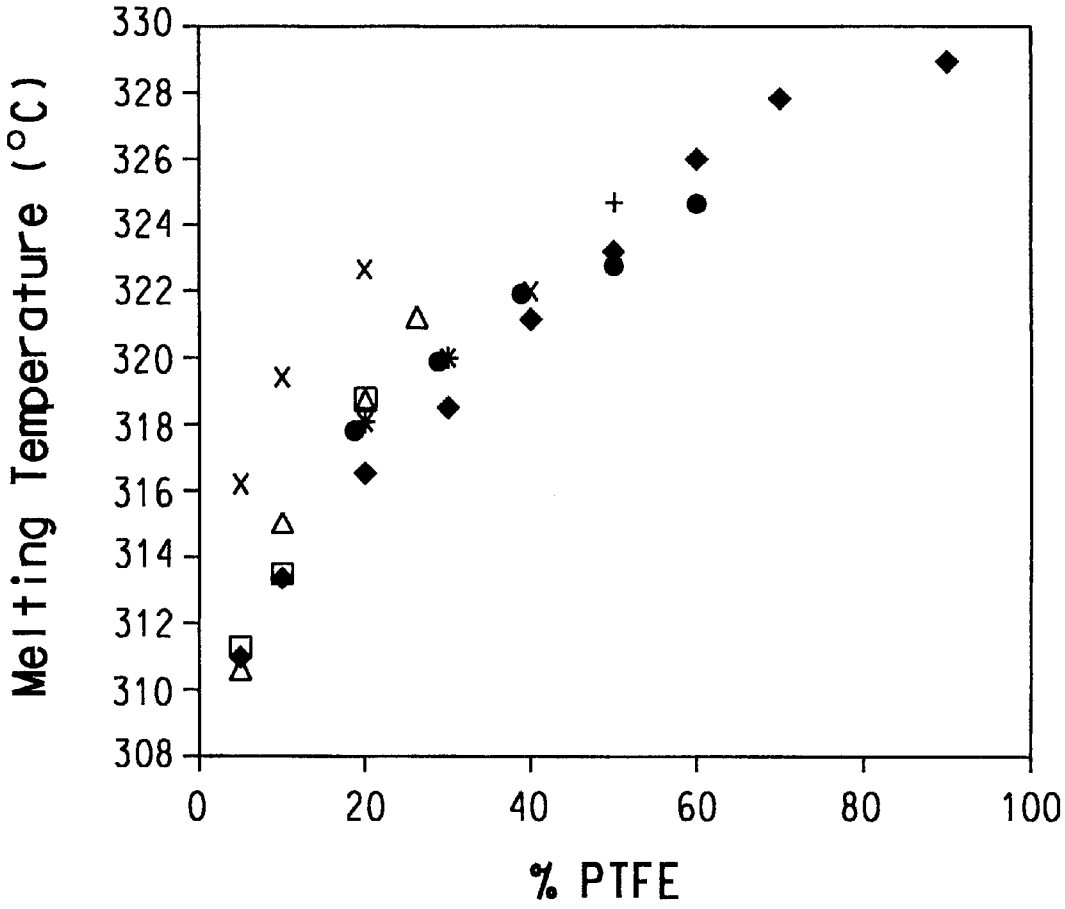
FIG. 2 is a graph plotting melting point (° C.) vs. % PTFE in blend compositions useful in the present invention after a second heating based on Differential Scanning Calorimetry (DSC).

The temperature of the dominant single melting peak on the second heat vs. PTFE content is shown in FIG. 2. In the case of the PFA 340/MP 1300 blends, the higher of the two melting peaks was used. As can be seen, the melting temperatures vary smoothly with composition indicating that the material is at least largely cocrystallized. Several points stand out as not conforming to this curve. The data from the PFA 340/MP 1300 blends exhibit behavior that is clearly different from the other blends and does not appear to be largely cocrystallized. It is believed that the behavior of this blend is governed by the extremely large viscosity difference between the two components that is greater than one order of magnitude which may interfere with adequate mixing and thus prevent blending on a sufficiently small scale to permit complete cocrystallization.

Figure 3:
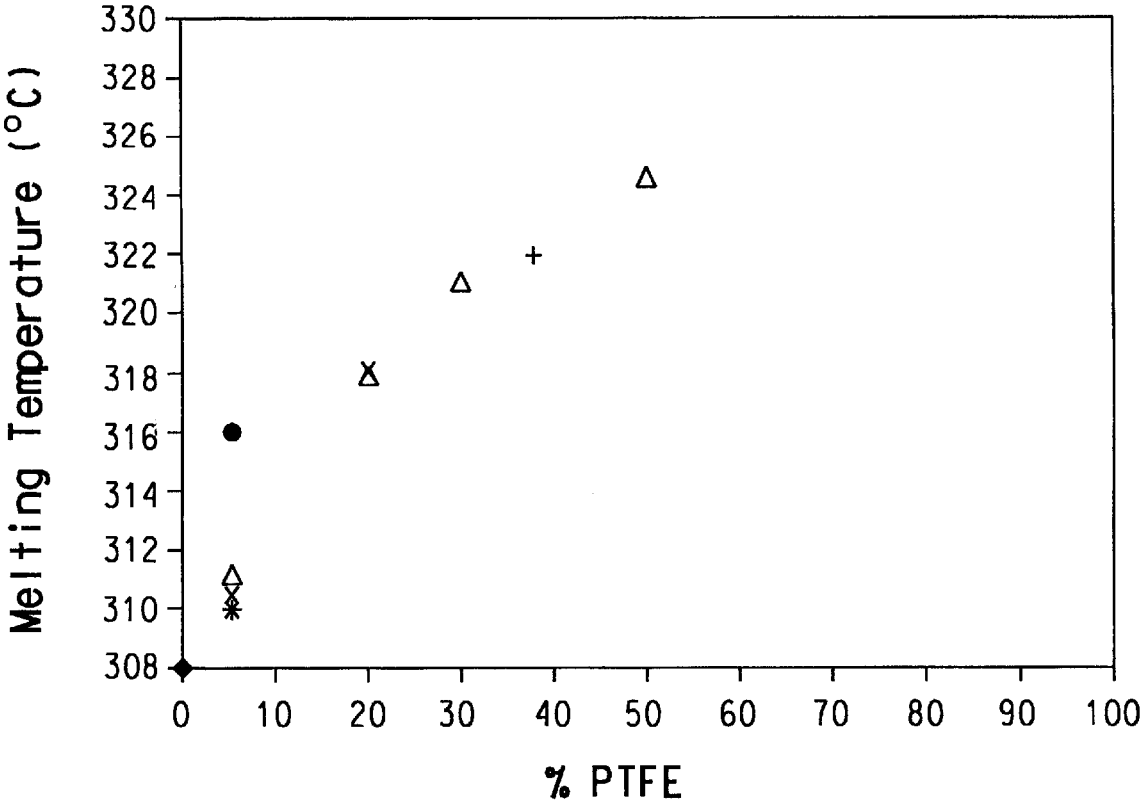
FIG. 3 is a graph plotting melting point (° C.) vs. % PTFE in fibers of the present invention based on Differential Scanning Calorimetry (DSC).

A smaller number of fibers were subjected to DSC testing and found to exhibit the same patterns. Results are shown in FIG. 3.

Melt-spinning conditions

Blends of Teflon® PFA 340 with Zonyl® PTFE were all melt-spun under uniform extrusion conditions: temperature=390° C.; die capillary length/diameter=12.7/1.00-mm; and shear rate=32/s. Blends of Teflon® PFA 350 and Zonyl® MP1200 were spun under a variety of conditions, as described later.

Two types of fiber spinning experiments were performed:

1) Determination of the maximum take-up speed, $V_{max}$—the extruded polymer strand was wound at increasing take-up speed until the filament broke. Several trials were averaged to determine $V_{max}$.
2) Collection of fibers for tensile testing—fibers were collected at a take-up speed that was 75% of the determined maximum, $V_{max}$.

Example 1

Blends of Teflon® PFA 340 with up to 20% of PTFE

Figure 4:
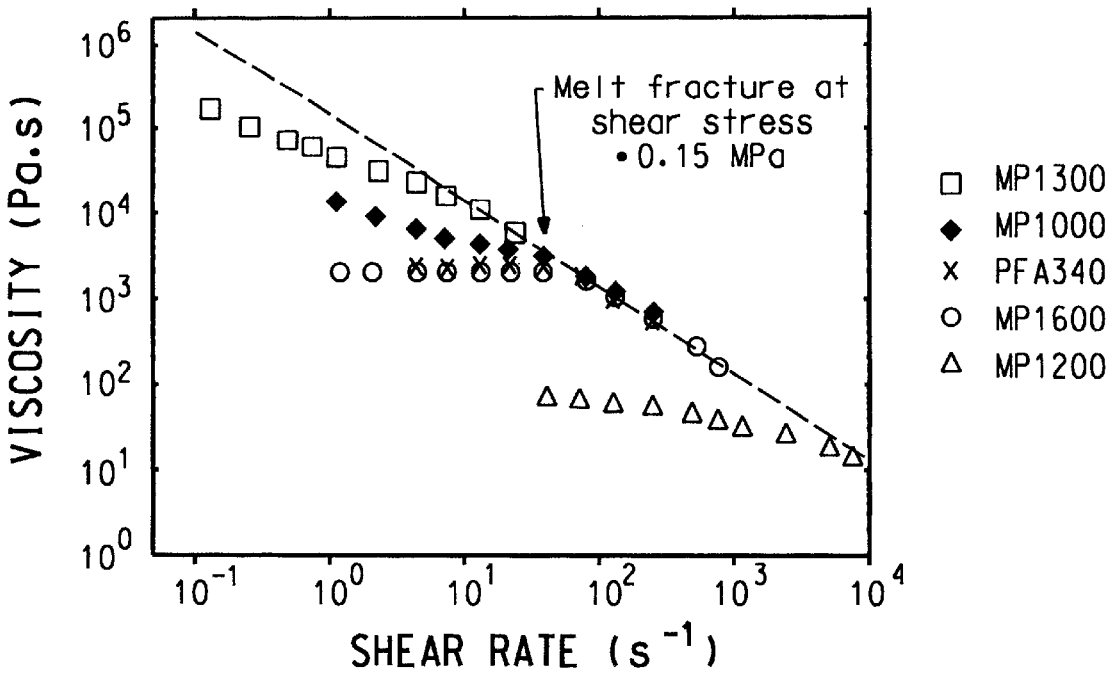
FIG. 4 is a graph plotting melt viscosity (Pa.s) vs. shear rate ($s^{-1}$) of Zonyl® PTFE grades and Teflon® PFA 340 at 375° C.

Blends of Teflon® PFA 340 containing up to 20% of four different Zonyl® PTFE were examined, The melt viscosities of each of the components were determined at 375° C. by capillary rheometry and are shown in FIG. 4. The components in order of their melt viscosity were:

MP1300>MP1000>PFA340>MP1600>MP1200.

Figure 5:
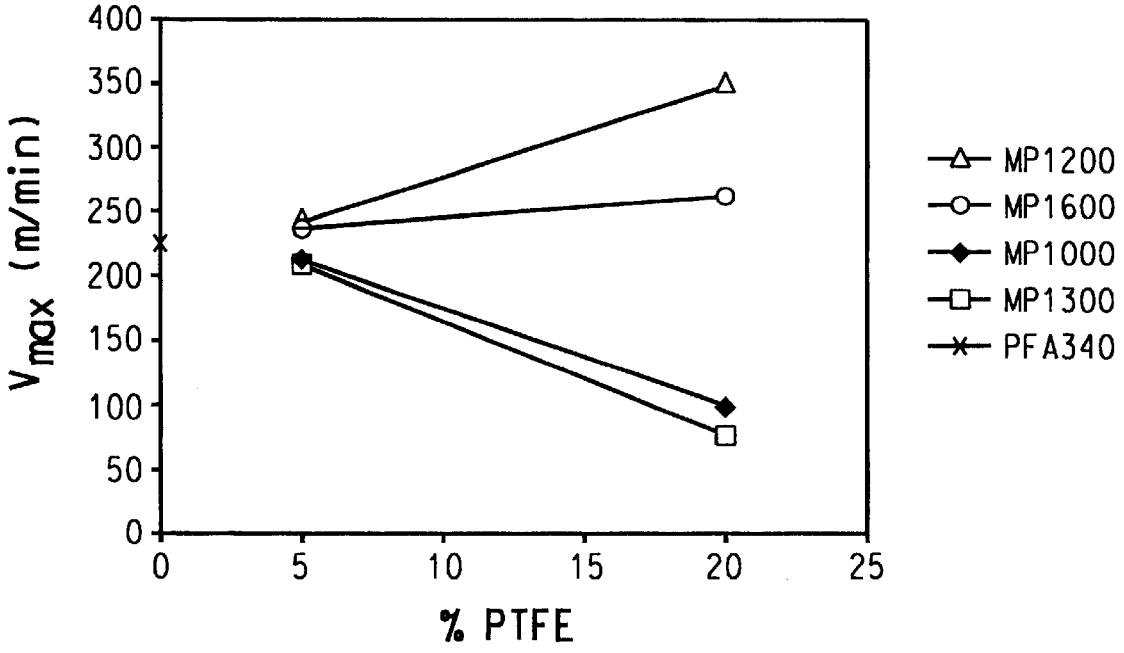
FIG. 5 is a graph plotting maximum spinning speed (Vmax (m/min)) of various PTFE/PFA blends as a function of PTFE content.

All blends were successfully melt-spun, and the maximum spinning speed, $V_{max}$, was determined. The effect of the different PTFE grades on spinning speed correlated with their melt viscosity, as shown in FIG. 5. Zonyl® PTFE having a lower melt viscosity increased $V_{max}$ of the blend compared to neat PFA 340; those having a higher melt viscosity diminished $V_{max}$ of the blend.

Fibers of these blends were melt-spun at 75% $V_{max}$ and collected. The tenacity of these fibers fell in the range of 0.71–1.00 g/den compared to the 0.90 g/den for neat PFA 340. Thus, the addition of up to 20% PTFE did not substantially alter the blend fiber tenacity from that of pure PFA.

Example 2

Blends of Teflon® PFA 340 with higher PTFE content

Figure 6:
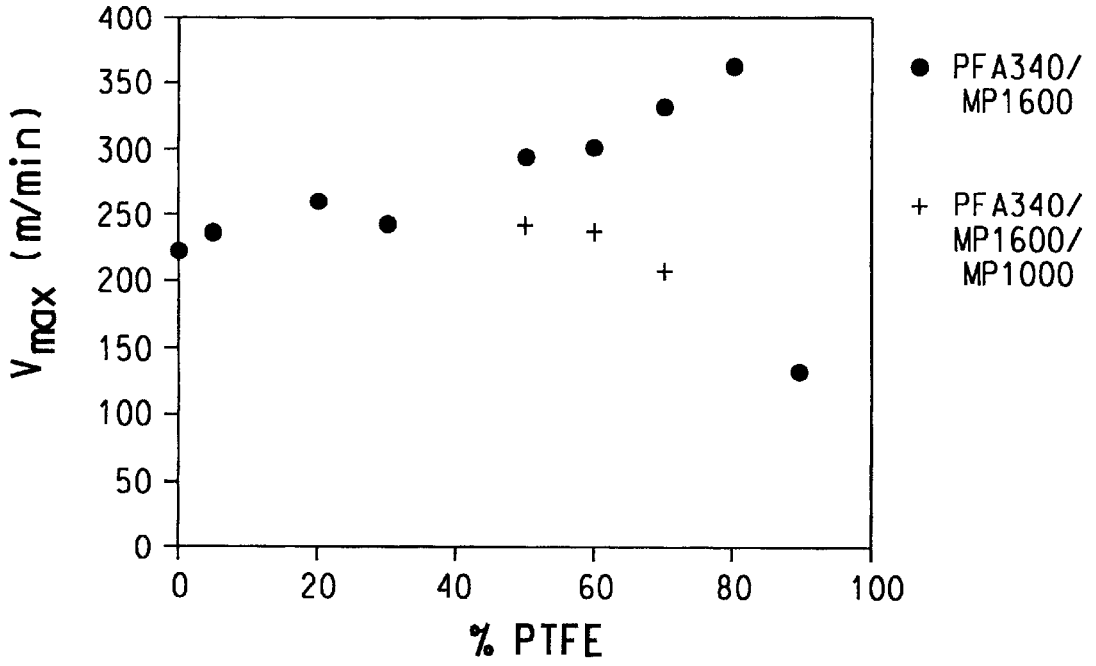
FIG. 6 is a graph of maximum spinning speed (Vmax (m/min)) of PFA 340/PTFE MP1600 and PFA 340/PTFE MP1600/PTFE MP1000 blends as a function of PTFE content.

Blends of Teflon® PFA 340 containing from 5 to 90% MP1600 PTFE and pure Teflon° PFA 340 were melt-spun. A plot of maximum spinning speed as a function of PTFE content is shown in FIG. 6. $V_{max}$ increased with increasing PTFE content up to 80% PTFE. This correlates with the expected decrease in viscosity produced by the addition of the lower viscosity PTFE component. Increasing the PTFE content from 80% to 90% resulted in a sharp decrease in $V_{max}$ as the spun fiber became increasingly weak and brittle. Neat PTFE MP1600 could not be spun under the conditions employed; the melt would not form a continuous filament as it exited the die. Solidified segments broke easily in a brittle manner, exhibiting virtually zero strength.

Figure 7:
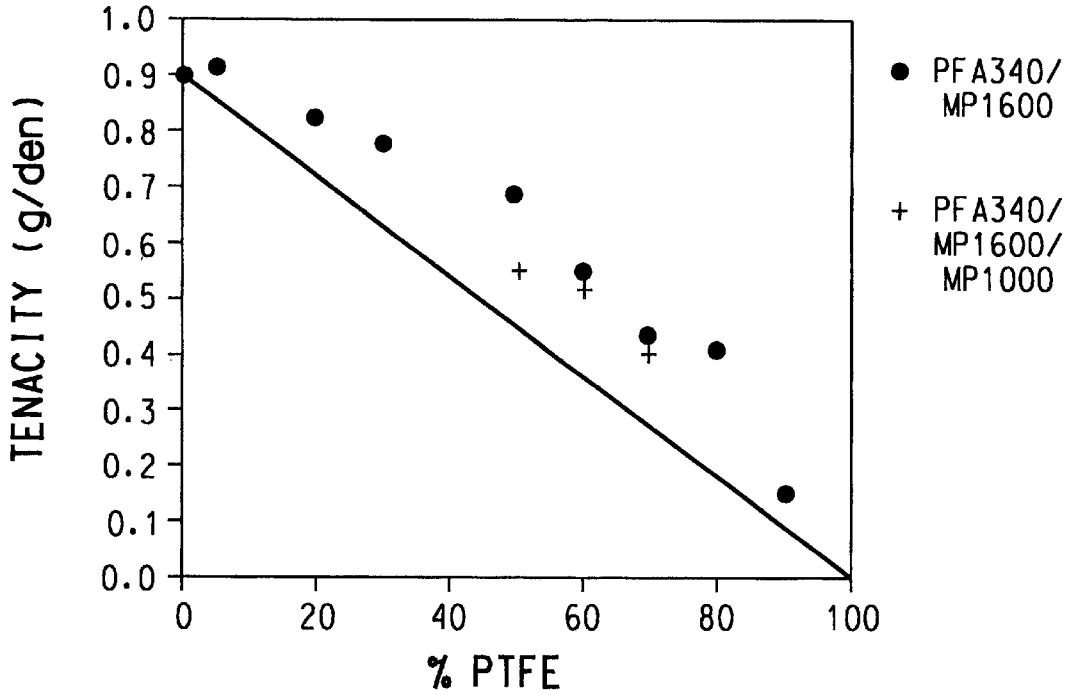
FIG. 7 is a graph of the tenacity (g/den) of fibers melt-spun from PFA 340/PTFE MP 1600 and PFA 340/PTFE MP1600/PTFE MP 1000 blends as a function of PTFE content.

The tenacity of fibers spun from PFA 340/PTFE blends decreased as a function of PTFE content, as shown in FIG. 7. However, even fibers containing up to 80% PTFE demonstrated reasonable tenacities of greater than 0.4 g/den. The solid line in FIG. 7 represents the tenacity that one would expect based upon a simple mixing rule assuming that pure Zonyl® MP1600 PTFE has zero tenacity. The PFA/PTFE blend data shown in FIG. 7 fall above this line, indicating that the PTFE component may be contributing to the strength of the fiber even though pure Zonyl® MP1600 PTFE could not be melt-spun under the conditions of this Example.

In addition to binary blends of PFA 340/MP1600, ternary blends of PFA 340/MP1600/MP1000 were also melt-spun. These compositions varied from 50–70% PTFE and were chosen such that the melt viscosity of the blend would roughly match that of pure PFA 340. $V_{max}$ of the ternary blends matched that of PFA 340 within 10% (FIG. 6), consistent with the explanation of $V_{max}$ being a function of melt viscosity (rather than PTFE content).

Fibers spun from the PFA 340/MP1600/MP1000 ternary blends demonstrated tenacities that were similar to those spun from binary PFA 340/MP1600 blends. The tenacities were again greater than one would expect from a simple mixing rule assuming pure Zonyl® MP1600 has zero tenacity.

Figure 8:
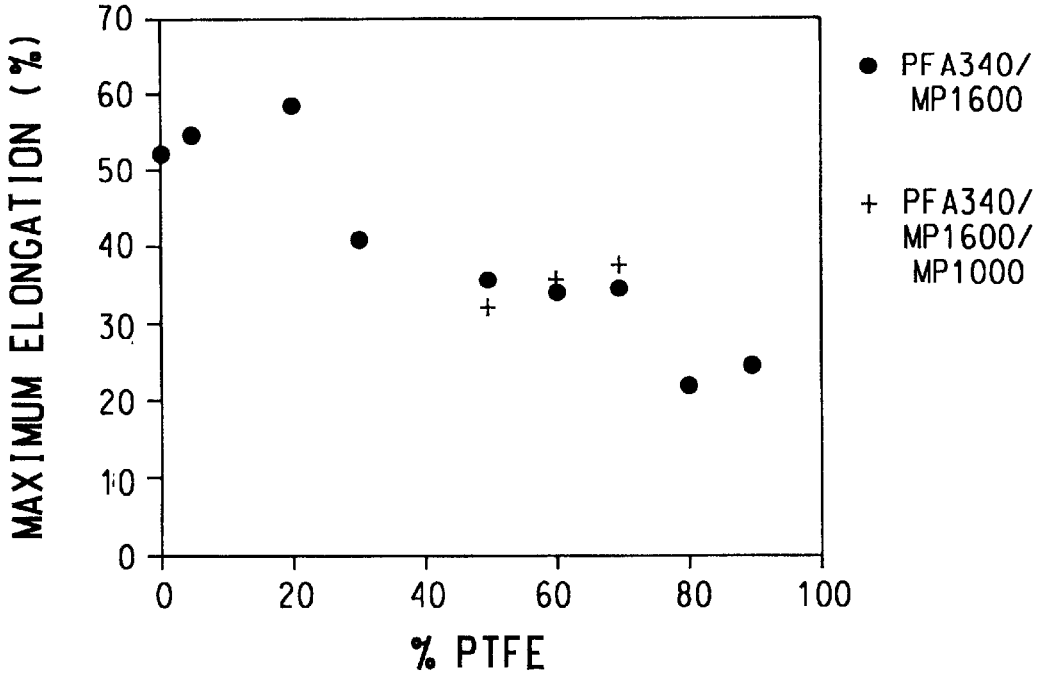
FIG. 8 is a graph of maximum elongation (percent) of fibers melt-spun from PFA 340/PTFE MP 1600 and PFA 340/PTFE MP 1600/PTFE MP 1000 blends as a function of PTFE content.

The elongation to break of fibers spun from PFA 340/PTFE blends decreased as a function of PTFE content as shown in FIG. 8 reflecting the low elongation contributed by the brittle PTFE component.

Example 3

PFA 350/Zonyl® MP1200 Blends

Figure 9:
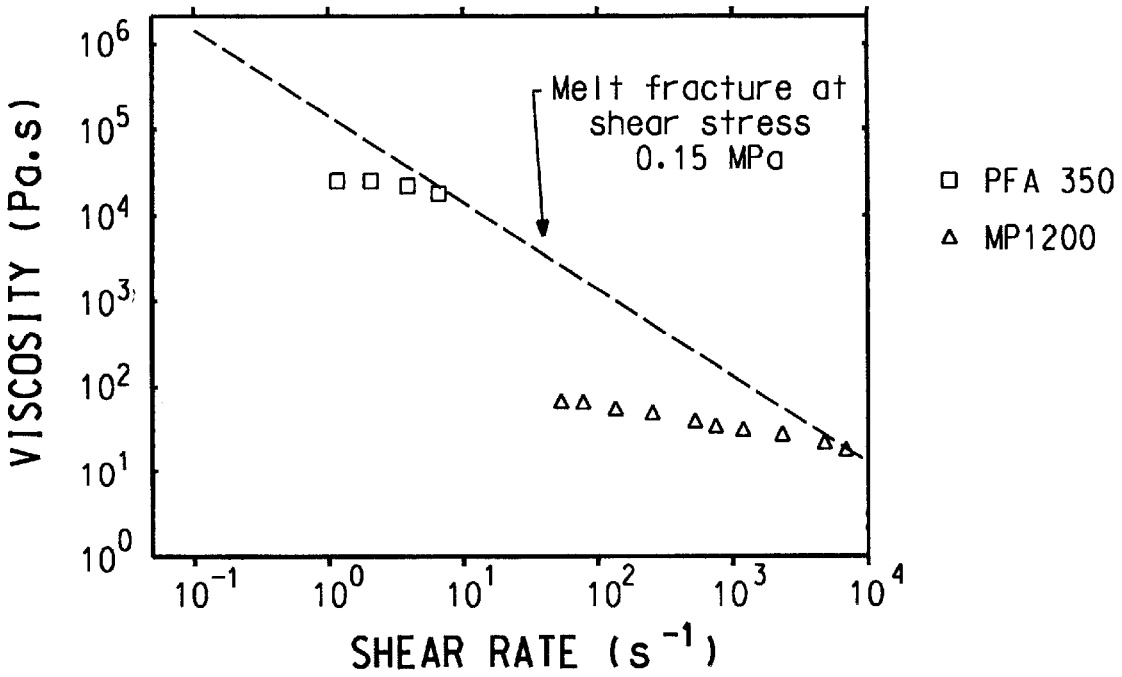
FIG. 9 is a graph of melt viscosity (Pa.s) of PFA 350 and PTFE MP1200 at 375° C.

Zonyl® MP1200 PTFE has a melt viscosity at 375° C. that is more than 100 times lower than that of PFA 350, as shown in FIG. 9. This example was performed in order to determine whether the addition of the low-viscosity PTFE could improve the spinnability of PFA 350.

Blends containing 20–90% Zonyl® MP1200 were melt-spun under a variety of conditions including temperatures of 350–390° C., die diameters of 0.76–3.18 mm, and shear rates of 2–75/s. The melt viscosity of these blends varied considerably as a function of the blend ratio. Spinning continuity for blends containing 20–70% PTFE MP1200 was established, but in each case draw resonance was observed, which is a flow instability characterized by an oscillation in the fiber diameter. The melt blend containing 90% MP1200 was too weak to be wound up.

COMPARATIVE EXAMPLE A

Figure 10:
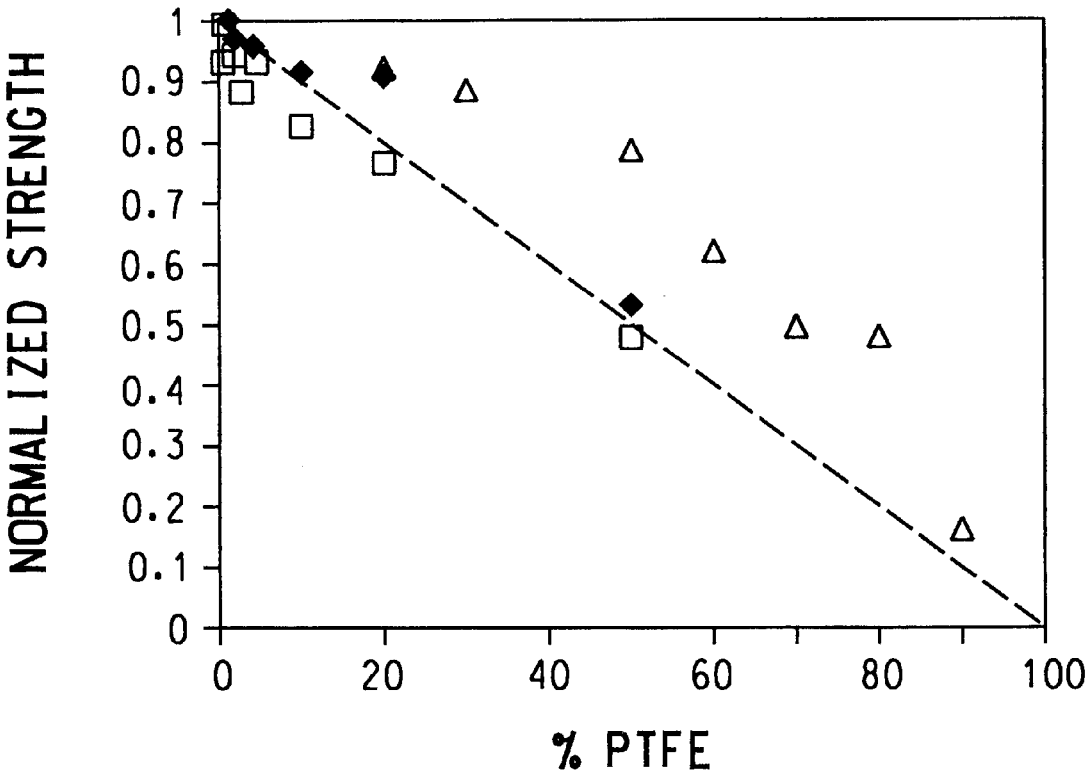
FIG. 10 is a graph plotting tensile strength vs. % PTFE for molded bars made via the method of U.S. Pat. No. 5,473,018 and fiber blends of the present invention.

The tensile strength of molded bars prepared as in Examples 7 and 8 from U.S. Pat. No. 5,473,018 (Namura et al.) was compared with the tensile strength of a fiber blend of Teflon® PFA 340/Zonyl® MP1600 PTFE of the present invention. Tensile strength for the bars were compared with the present fibers with all data normalized to a PFA control. In these examples of Namura et al. which give data for relatively high concentrations of PTFE, there is no hint of any deviation from a simple mixing rule for strength as a function of composition. (See FIG. 10.)

EXPERIMENTAL METHODS FOR EXAMPLES 4–7

An intense powder mixing method was developed which involved uniformly blending powders of PFA and PTFE such that a pinch of the blended powders analyzed by DSC (differential scanning calorimetry) gave the correct quantitative composition, which was calculated based upon the heat of fusion of the individual components. Quantitative amount of the polymers were weighed into a plastic gallon container for a total net weight of 2.5 lbs. (1.1 kg) Intense mixing was accomplished using a 4.25 in (10.8 cm) high and 3.6 in (9.1 cm) diameter cage-like propeller mixer on a shaft driven by air motor at high speed. The speed was adjusted until the stirred powders flowed like liquid, that is, the powder would rise up around the container and flow into the center of the rotating mixer. Under such intense mixing, the container also rotated slowly by itself facilitating good mixing. After 30 min, the blended content was poured into another clean gallon container and mixed again under the same conditions and time. The powder blends were then pressed into pellet form for ease of feeding into an extruder.

SPINNING OF EXAMPLES 4–7

Figure 11:
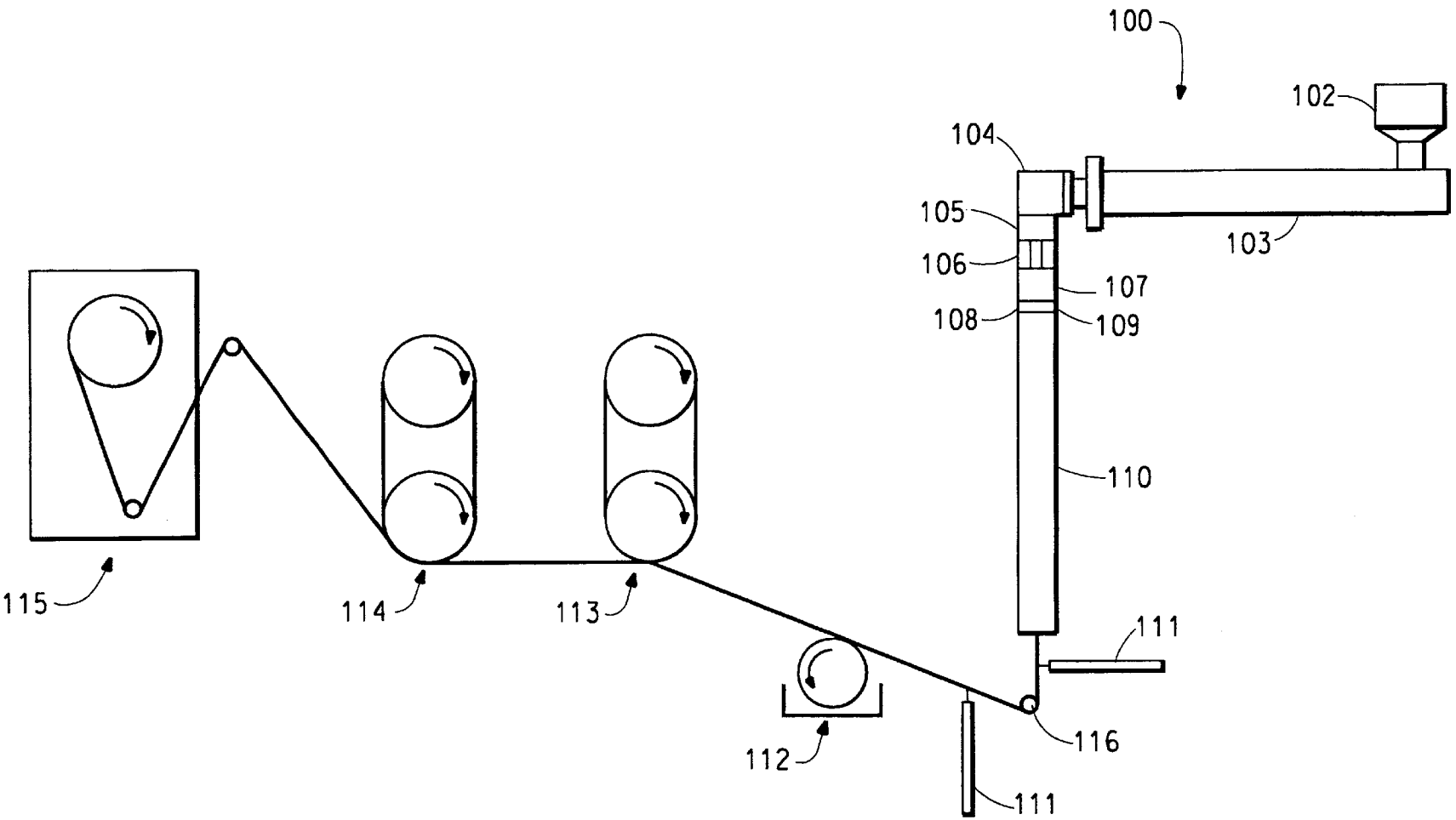
FIGS. 11 and 12 are schematic representations of melt spinning apparatus useful in forming the present fibers.

Examples 4–7 were spun on a melt spinning apparatus, such as the melt spinning apparatus 100, shown in FIG. 11. Shown are feed hopper 102 into which the polymer composition is fed, preferably in the form of pellets. These pellets are heated and conveyed through screw extruder 103. After the polymer or blend composition is melted, it is conveyed under pressure to pump block 104, through pack filter 105, transfer line 106 to spinneret 107 having face 108. Glass sleeve 109 permits viewing of the molten filaments. Molten fluoropolymer composition is extruded through one or more apertures of face plate 108 in spinneret 107 to form a continuous strand which is directed through elongated annealer 110 wherein the strand is shielded to prevent rapid cooling. Upon leaving the annealer, the spun fiber travels through pigtail guides 111, change of direction guides 116 to kiss roll 112 for an optional finish application, to take up roll 113, draw roll 114, and windup 115. Additional draws may be added as well as relaxation rolls.

Figure 12:
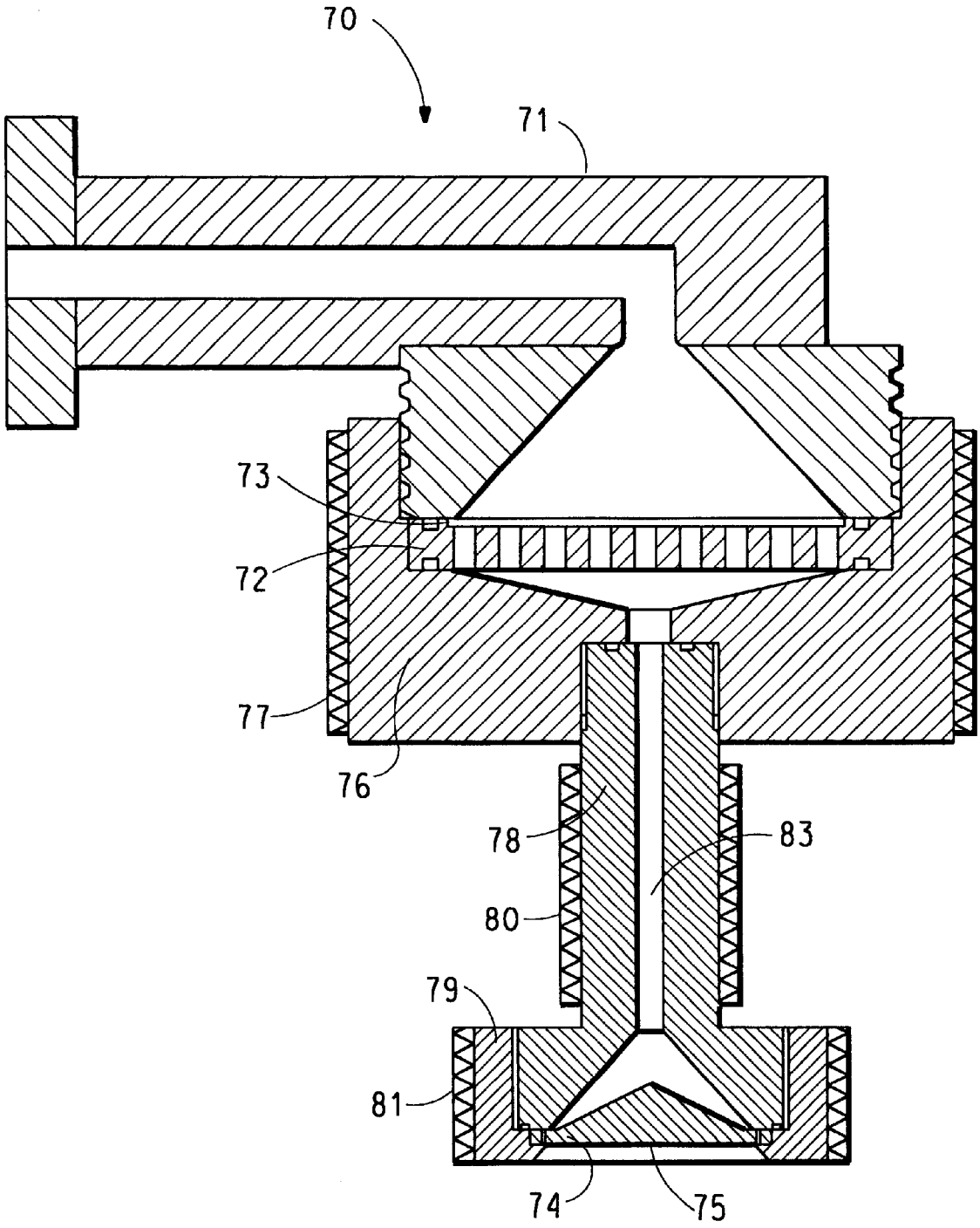

The molten polymer flow path after leaving the pump block 104 is described in more detail as follows: The melt is conveyed to the spinning apparatus shown in FIG. 12. Such melt flowed through the channel of adapter 71 into the cavity above the filtration screens 73. The filtered melt traveled down the center channel of transfer line 78 into the cavity above the cone top disc spinneret 74. Finally, the melt was extruded out of the capillary holes of the spinneret as molten filaments, which were stretched before they eventually cooled in the air and solidied within an annealer 110, shown in the spinning apparatus 13. Spinneret nut 79 holds disc spinneret 74 to the bottom of face 82 of transfer line 78. Narrow internal flow channel 83 in transfer line 78 reduces the volume and residence time of the fluoropolymer composition at high temperature to further reduce the chance of degradation. Transfer line 78 also provides a means of stepping up to an intermediate temperature between filtration means 73 and spinneret 74 via its separate heating means 80. At the same time, the transfer line embodiment shown provides more uniform and faster heat transfer. An additional advantage of this embodiment is that disc spinneret 74 can be replaced without having to remove the filter pack, and the disc can be easier to fabricate. Also shown are adapter 71, multiple distribution channels 72 disposed between the supports for filtration means 73, retaining nut 76, chamber 84 and face plate 75.

Example 4

2.5 pounds each of 90/10 weight ratio of Zonyl® MP1600N PTFE/PFA 340 were mixed as described above. The spin was made using a 30-mil (0.762 mm) diameter 30-hole spinneret at a screw rpm of 7.69. The 90/10 blend was spun using the following temperature (° C.) profile:

| Screw | | | Clamp | Screw | Spinneret | Pack | Transfer | |
|---|---|---|---|---|---|---|---|---|
| 1 | 2 | 3 | Ring | Adaptr | Adapter | Filter | Line | Spinneret |
| 350 | 370 | 380 | 380 | 380 | 380 | 380 | 450 | 500 |

The measured throughput was 37.8 gpm for a shear rate of 323/sec. The maximum speed at which a first filament break (FFB) occurred was 378 mpm. Measured filament properties (denier/tenacity/break elongation/modulus) were: 28/0.09 gpd/2.2%/5.5 gpd. DSC measurement on the fiber showed a single melting peak at 326.8° C. on first heat and 328.0° C. on second heat indicating that the two polymers were homogeneously blended and were dissolved into each other into a single homogeneous melt phase.

Example 5

A 80/20 MP1600N PTFE/PFA 340 blend was prepared as in Example 4. The blend was spun using a 30-mil (0.762 mm) diameter 30-hole spinneret at a screw speed of 7.69 rpm using the following temperature (° C.) profile:

| Screw | | | Clamp | Screw | Spinneret | Pack | Transfer | |
|---|---|---|---|---|---|---|---|---|
| 1 | 2 | 3 | Ring | Adaptr | Adapter | Filter | Line | Spinneret |
| 315 | 330 | 340 | 340 | 340 | 340 | 340 | 450 | 520 |

The measured throughput was 39.8 gpm for a shear rate of 340/sec. Maximum first filament break spinning speed was 426 mpm. Measured filament properties (denier/tenacity/break elongation/modulus) were: 31/0.11 gpd/2.6%/7.9 gpd. DSC measurement on the fiber showed a single melting peak at 325.6° C. on first heat and 328.4° C. on second heat indicating that the two polymers were homogeneously blended and were dissolved into each other into a single homogeneous melt phase.

Example 6

A 70/30 MP1600N PTFE/PFA 340 blend was prepared as described in Example 4 and spun using the following temperature (° C.) profile:

| Screw | | | Clamp | Screw | Spinneret | Pack | Transfer | |
|---|---|---|---|---|---|---|---|---|
| 1 | 2 | 3 | Ring | Adaptr | Adapter | Filter | Line | Spinneret |
| 315 | 330 | 340 | 340 | 340 | 340 | 340 | 450 | 500 |

The maximum first filament break (FFB) achieved was an increasing function of the throughput as shown below:

| Sample Number | 7 | 8 | 9 | 6 |
|---|---|---|---|---|
| Throughput (gpm) | 9.3 | 16.3 | 21.0 | 38.9 |
| Max. FFB (mpm) | 235 | 318 | 550 | 864 |
| Ultimate Speed (mpm) | 576 | 513 | 852 | not measured |
| Shear Rate (1/sec) | 80 | 139 | 180 | 333 |

Measured filament properties (denier/tenacity/break elongation/modulus) for samples 7 and 9 were:

Sample 7: 4.5/0.43 gpd/30%/5.7 gpd

Sample 9: 9.7/0.29 gpd/62%/4.1 gpd

DSC measurement on Sample 7 showed a dominant single melting peak at 323.2° C. and a minor peak at 325.9° C. on first heat. On second heat, only a single peak at 327.4° C. was observed.

Example 7

A 60/40 MP1600N PTFE/PFA 340 blend was similarly prepared and spun under the same temperature profile as for the 70/30 blend in Example 6. The maximum first filament break (FFB) achieved was an increasing function of the throughput and shown as follows:

| Sample Number | 1 | 7 |
|---|---|---|
| Throughput (gpm) | 9.1 | 26.4 |
| Max. FFB (mpm) | 219 | 714 |

-continued

| Sample Number | 1 | 7 |
|---|---|---|
| Ultimate Speed (mpm) | 858 | |
| Shear Rate (1/sec) | 78 | 226 |

Spinning at 9.1 gpm throughput, the yarn was found to be thick and thin, which may be the result of draw resonance. Applying air inlet flow rate of 220 cfh (6.23 cubic meter per hour) to the annealer uniformized the yam thickness.

Measured filament properties (denier/tenacity/break elongation/modulus) for Sample 1 were: 3.9/0.59 gpd/51%/7.8 gpd.

Fibers spun at a take-up speed of 100 mpm exhibited an exceptional high drawability of up to 3.65× that of PFA 340 at 290° C. with a take-up speed of 100 mpm. This blend fiber exhibited only about 1.2× draw ratio when drawn at room temperature. (Pure PFA 340 normally has a maximum draw ratio of about 2×.) Pure PTFE MP-1600N was not drawable at temperatures up to 290° C.

The 3.65× highly drawn blend fiber (designated Sample 5) was white and dull which is similar to pure PTFE as opposed to transparent or translucent PFA 340. The fiber spun at the same take-up speed of 100 mpm but without draw was transparent (Sample 1). Measured filament properties (denier/tenacity/break/elongation/modulus) for the highly drawn sample (Sample 5) were: 7.8/0.63 gpd/15%/7.7 gpd. DSC measurements for samples 1 and 5 showed the following:

| | First Heat | Second Heat |
|---|---|---|
| Sample 1 | major peak = 321.8; minor peak = 325.3° C. | 325.3° C. |
| Sample 5 | major peak = 322.1; minor peak = 325.9° C. | 326.4° C. |

Example 8

8 kilograms each of MP1600N and PFA 340 were mixed and pelletized as described above and spun using the following temperature (° C.) profile:

| Screw | | | Clamp | Screw | Spinneret | Pack | Transfer | |
|---|---|---|---|---|---|---|---|---|
| 1 | 2 | 3 | Ring | Adaptr | Adapter | Filter | Line | Spinneret |
| 315 | 330 | 340 | 340 | 340 | 340 | 340 | 400 | 500 |

At a screw rpm of 22.5 for a measured throughput of 43.9 gpm, the shear rate was 335/sec. Using the same spinneret described in Example 4, the maximum FFB speed attained was 1,773 mpm. A total of 12.3 kg of yarn was produced at 660 mpm having a take-up speed of 400 mpm using a draw temperature of 290° C. Excellent spinning continuity was achieved. Each bobbin sample was voluntarily doffed at one hour each yielding a net weight of 2.63 kg of fiber. Measured filament properties (denier/tenacity/break elongation/modulus) for the production yarn were: 21/0.36 gpd/134%/2.8 gpd.

What is claimed is:

1. A fiber, comprising a composition comprising a blend of at least one poly(tetrafluoroethylene) and at least one poly(tetrafluoroethylene-co-perfluoro-alkylvinylether).

2. The fiber of claim 1 wherein the composition has essentially a single melting point.

3. The fiber of claim 1 wherein the composition has two or more melting points.

4. The fiber of claim 1 wherein the amount of poly (tetrafluoroethylene) present in the blend is greater than about 50% by weight based on the total weight of the blend.

5. The fiber of claim 4 wherein the amount of PTFE ranges from about 50% to about 90%.

6. The fiber of claim 4 wherein the amount of PTFE ranges from about 50% to about 80%.

7. The fiber of claim 1 wherein the tenacity is greater than about 0.2 gpd.

8. The fiber of claim 1 wherein the break elongation is greater than about 20%.

9. The fiber of claim 1 having a substantially white physical appearance.

10. A process of forming a fiber comprising a composition comprising a blend of at least one poly(tetrafluoroethylene) and at least one poly(tetrafluoroethylene-co-perfluoroalkylvinyl ether), comprising the steps of:

(a) contacting at least one poly(tetrafluoroethylene) with at least one poly(tetrafluoroethylene-co-perfluoroalkylvinyl ether) to form a blend;

(b) heating the poly(tetrafluoroethylene) to a temperature above the melting point of the poly(tetrafluoroethylene) prior to, simultaneously with, or subsequent to contact with the poly(tetrafluoroethylene-co-perfluoroalkylvinyl ether);

(c) heating the poly(tetrafluoroethylene-co-perfluoroalkylvinyl ether) to a temperature above the melting point of the poly(tetrafluoroethylene-co-perfluoroalkylvinyl ether) prior to, simultaneously with, or subsequent to contact with the poly (tetrafluoroethylene); and (d) extruding the molten blend through a die to form a fiber.

11. The process of claim 10 further comprising drawing the fiber.

12. The process of claim 11 wherein the drawability of the fiber is at least 25% greater than a fiber comprising poly (tetrafluoroethylene-co-perfluoro-alkylvinyl ether) alone.

13. The process of claim 10 wherein the amount of poly(tetrafluoroethylene) is greater than about 50%.

14. The process of claim 10 wherein the viscosity of the poly(tetrafluoroethylene) is within two orders of magnitude of the viscosity of the poly(tetrafluoroethylene-co-perfluoroalkylvinyl ether).

15. The process of claim 10 wherein he spinning speed is greater than about 200 mpm.

16. The process of claim 10 wherein the shear rate is greater than 100/sec.

17. The process of claim 10 further comprising cooling the blend of step (c) followed by reheating the blend to a temperature above the melting points of the poly (tetrafluoroethylene) and the poly(tetrafluoroethylene-co-perfluoroalkylvinyl ether) and optionally repeating the cooling and reheating step at least once.

18. The process of claim 10 further comprising before extruding the molten blend, mixing the blend at a temperature above the melting point of the component having the higher melting point.

19. A process of preparing a cocrystallized blend comprising the steps of (a) contacting at least one poly (tetrafluoroethylene) with at least one poly (tetrafluoroethylene-co-perfluoro-alkylvinyl ether) wherein the viscosity of the poly(tetrafluoroethylene) is within two orders of magnitude of the viscosity of the poly (tetrafluoroethylene-co-perfluoro-alkylvinyl ether); (b) mixing the poly(tetrafluoroethylene) and poly (tetrafluoroethylene-co-perfluoro-alkylvinyl ether thoroughly to form a blend; (c) heating the poly (tetrafluoroethylene) above the melting point of the poly (tetrafluoroethylene) prior to, simultaneously with, or subsequent to contact with the poly(tetrafluoroethylene-co-perfluoro-alkylvinyl ether); and (d) heating the poly (tetrafluoroethylene-co-perfluoro-alkylvinyl ether) above the melting point of the poly(tetrafluoroethylene-co-perfluoro-alkylvinyl ether) prior to, simultaneously with or subsequent to contact with the poly(tetrafluoroethylene).

* * * * *